US005103798A

United States Patent [19]

McGraw et al.

[11] Patent Number: 5,103,798

[45] Date of Patent: Apr. 14, 1992

[54] ARCHERY ARM GUARD

[76] Inventors: Michael F. McGraw, 9972 Boucher Rd., Otter Lake, Mich. 48464; Aaron F. Baker, 4425 Central St., Columbiaville, Mich. 48421

[21] Appl. No.: 422,002

[22] Filed: Oct. 16, 1989

[51] Int. Cl.[5] ..... F41B 5/14

[52] U.S. Cl. ..... 124/88; 124/23.1

[58] Field of Search ..... 124/88, 86, 87, 24 R, 124/23 R, DIG. 1, 24.1, 23.1, 25.6

[56] References Cited

U.S. PATENT DOCUMENTS

| | | | |
|---|---|---|---|
| 4,329,972 | 5/1982 | Wilson | 124/24 R |
| 4,332,231 | 6/1982 | Napier et al. | 124/87 X |
| 4,377,152 | 3/1983 | Saunders | 124/88 |
| 4,452,222 | 6/1984 | Quartino et al. | 124/88 X |
| 4,478,203 | 10/1984 | Hayes | 124/88 X |
| 4,662,344 | 5/1987 | Mitchell | 124/88 X |

*Primary Examiner*—Peter M. Cuomo

[57] ABSTRACT

Disclosed is an arm guard for the protection of the bow arm of an archer. The arm guard comprises an elongated rigid member attachable to a bow at the handle of the bow generally beneath the bow hand of the archer. The elongated member extends rearwardly and closely parallel to the bow arm of the archer, to a point substantially at or beyond the elbow region of the bow arm, with the rearward portion of the elongated member curving towards the bow arm. The elongated member thus presents a physical barrier to a released bow string from striking the arm of the archer.

9 Claims, 2 Drawing Sheets

FIG 1
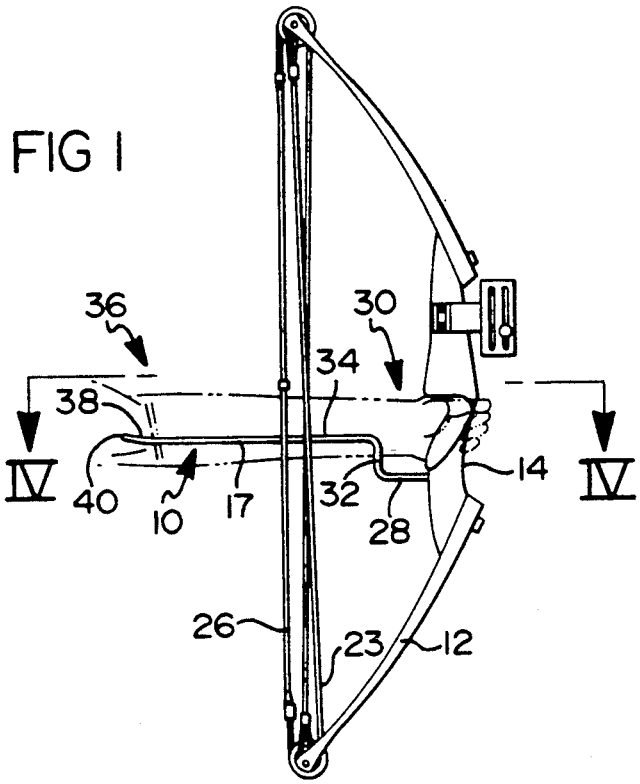
FIG 2
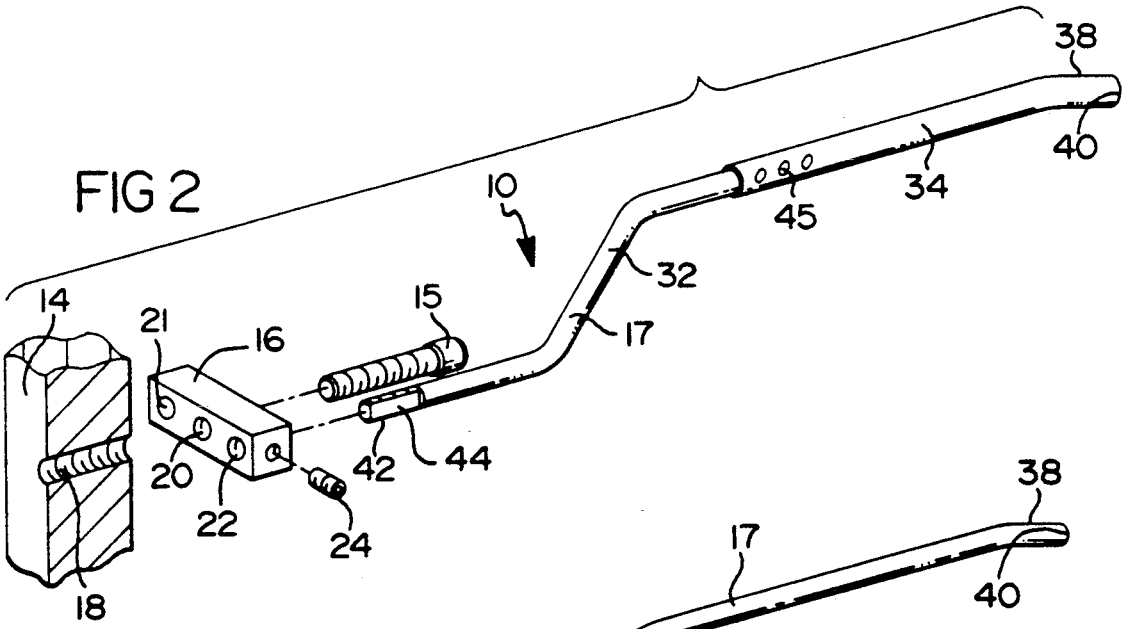
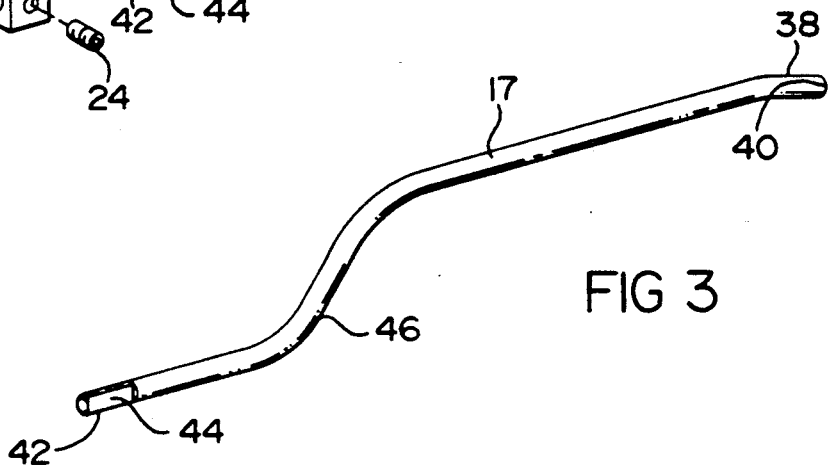
FIG 3

ARCHERY ARM GUARD

BACKGROUND OF THE INVENTION

1. Field of the Invention

This invention relates generally to archery equipment. More specifically, the present invention relates to a bow-mounted device for protecting the bow arm of the archer from injurious contact with a bow string.

2. Description of the Related Art

In archery, the string of the bow has three positions:

(1) Quiescent, i.e. when the string is operably attached to the bow and no pull is exerted by the archer;

(2) Drawn, i.e. when the string is pulled to flex the bow preparatory to shooting an arrow; and (3) Kinetic, i.e. when the string is moving forward to launch the arrow.

When an archer draws the bow string and then releases it, the kinetic string will travel from the drawn position to just forward of the quiescent position and then return to the quiescent position. The kinetic string will have a travel path generally defining a plane through the longitudinal midline of the bow.

Due to the body positioning of the archer when engaging in archery activities, i.e., the archer's shooting form; when an archer fully draws the bow string and releases it, the kinetic string may contact the archer's chest or bow arm, i.e., the arm holding the bow, giving pain and injury to the archer.

In the recurve, or long bow the body area susceptible to string contact is that portion of the bow arm from the protruding elbow joint down to the wrist area, since the quiescent string of the long bow normally is a short distance from the bow, placing the quiescent string in the wrist area of the bow arm when the bow is held in shooting form.

However, the long bow has now been suplanted in popularity of use by the compound bow. The force required to bring the bow string to a drawn position and the force the kinetic bow string will apply to the arrow when released, i.e., the draw weight of the bow, has become commonly higher with the advent of the compound bow. As has always been known to the archer, bad bow arm positioning, or a bad release of the draw string, or both, may cause the bow string to contact the archer's bow arm resulting in pain and injury to the archer. With the higher bow string forces produced by the now ubiquitous compound bow, such bow string contact represents a potential for serious injury to a great many archers. Especially susceptable to kinetic bow string contact from the compound bow is that portion of the bow arm around the elbow, since the quiescent bow string of a compound is located well away from the bow, placing the quiescent string at the upper forearm when the bow is held in the shooting form.

Thus, there exists a need for a device attachable to standard compound bows or long bows which will protect the archer's bow arm, or remove the archer's clothing from the path of the kinetic string so as not to cause injury to the archer or spoil his shooting of the arrow. Such a need particularly exists in the increasingly popular sport of bow hunting where the archer may be far removed from medical attention and a shot at the archer's quarry may be a once in a lifetime opportunity.

The art which has evolved to data has not fully addressed this issue.

For example, U.S. Pat. No. 3,623,468 to Crest, discloses a bow 'arm guard' and positioner device mountable to a long bow handle. A bendable rod is disclosed as extending in three planes to place a vertical portion of the rod lateral to the midline of the bow. This vertical portion contacts the medial surface of the archer's bow arm at a point between the wrist and elbow, generally just beyond the quiescent string of the long bow as held by the archer. The device is not a physical barrier to bow string contact with the upper forearm, but instead is a bow arm indexing means primarily for target shooting which relies on positioning the archer's arm lateral to the path of the kinetic bow string to thereby function as a "guard".

U.S. Pat. No. 4,836,177 to Williams discloses an archery bow wrist brace attachable to a bow handle. The wrist brace has a generally U-shaped rigid frame extending rearwardly from the bow with a transverse arm brace connecting the legs of the rigid frame. The brace engages the lower forearm of the archer's bow arm and provides a steadying means surrounding the bow arm proximal to the archer's wrist. This wrist brace may provide some protection against a bow string striking the archer's wrist or lower forearm but does not protect the upper forearm.

The known devices provide no physical barrier to the string striking that most vulnerable upper forearm and elbow region of the bow arm, especially when the archer is using a compound bow. Further, neither of the devices removes bulky clothing such as hunting overalls, from the kinetic string path, to insure that the shot is not fouled by string contact with that clothing.

SUMMARY OF THE INVENTION

An arm guard for use with an archery bow for the protection of the bow arm of the archer, is disclosed as comprising an elongated member attachable to the bow and means for mounting the elongated member to the bow. The elongated member extends rearwardly from the bow along a line lateral to a midline of the bow to a point substantially at or beyond the elbow region of an archer's bow arm.

The elongated member curves outwardly, i.e., further away from the midline of the bow, at a rearward portion of the elongated member. The elongated member thus forms a physical barrier preventing the kinetic bow string from striking the archer's entire forearm and is thus usable for either a compound bow or a long bow. The elongated member rests upon the archer's bow arm due to the outward curvature of the elongated member, thereby preventing the bow string from slipping beneath the elongated member and inflicting injury upon the archer. The elongated member will generally be rod-shaped and have a rounded end to further prevent the bow string from slipping beneath the rod. The rod-to-arm contact further provides a readily sensed positioning means for the shooting form of the archer especially when the bow arm is unencumbered by bulky clothing. Conversely, when the archer is wearing bulky clothing the arm guard will keep such clothing out of the kinetic string path.

The rod used as the elongated member in the present invention is preferably a rigid member so as to provide maximum protection to the bow arm and so as to be able to withstand the rigors of field use when the archer is bow-hunting. The rod is also preferably generally planar along most of its length and mountable on the bow by a separate mounting block which places the rod in a position lateral to the longitudinal midline of the bow.

Other attendant advantages will be more readily appreciated as the same becomes better understood by reference to the following detailed description and considered in connection with the accompanying drawings in which like reference symbols designate the parts throughout the figures.

BRIEF DESCRIPTION OF THE DRAWINGS

FIG. 1 is an environmental side view of an arm guard according to the present invention, the arm guard being formed integrally with the bow.

FIG. 2 is a persepctive view of the arm guard shown with a means for attachment to a commercially available bow.

FIG. 3 is a perspective view of an alternative embodiment of the elongated member of the arm guard.

DESCRIPTION OF THE PREFERRED EMBODIMENT

Figure 4:
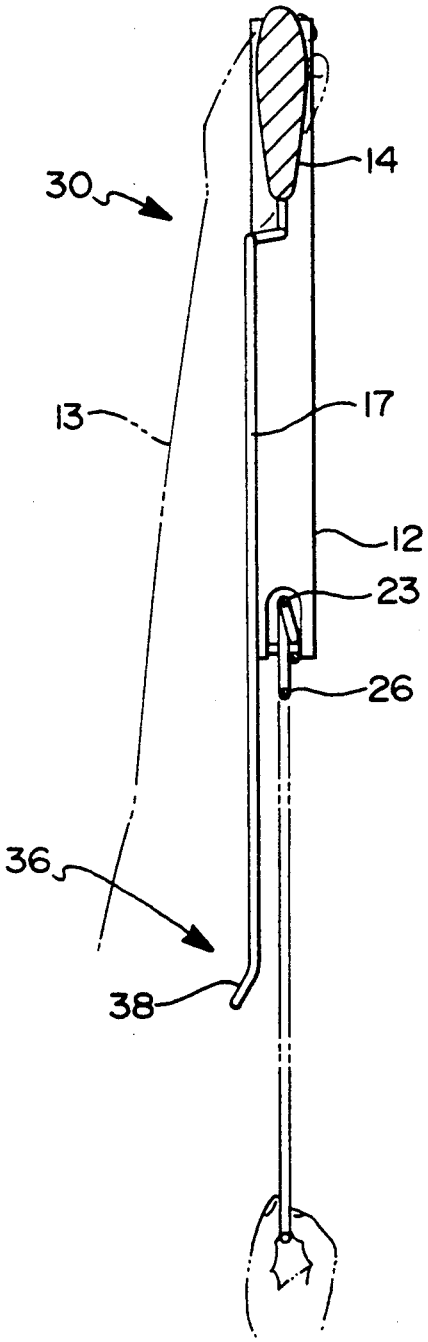
FIG. 4 is a top view of the arm guard taken along line IV—IV of FIG. 1.

Shown in FIG. 1 is an archery arm guard, generally at 10, attachable to an archery bow 12 for the protection of the archer's bow arm 13 against a kinetic bow string contact, especially the elbow region 36 which is most vulnerable to string contact when using a compound bow. The bow 12 illustrated is of compound type favored by the vast majority of bow hunters, but the guard 10 will work equally well with a conventional type, or long bow due to the protection of the entire forearm of the bow arm 13 by the guard 10. As used herein, positional terms such as horizontal, rearward, lower, etc. are used in their ordinary sense in relation to an archer standing on the flat ground and taking an ordinary archery shooting stance towards a target on the same ground some distance forward of the archer.

Most bows produced nowadays for the serious archer, whether a hunter or a target shooter, are provided with various attachment points about the bow handle 14 for the anchoring thereto of balancing shafts, range finders, sighting devices, cable guards, etc. Thus, in the preferred embodiment, as seen in FIG. 2 a mounting block 16 will be attached to the bow handle 14 by the bolt 15 inserted therethrough into a mounting hole 18 located in the lower portion of the bow handle 14. The mounting block 16 then secures an elongated member, or rod 17, to the bow 12. The bolt hole 20 and rod hole 22 may, if desired, be threaded to accept threaded members therethrough, although this is not strictly necessary.

The mounting block 16 is a generally rectangular-shaped body, or block, having a transverse, bolt hole 20 therethrough, and a rod hole 22 therethrough parallel to the bolt hole 20 and on the bow arm side thereof. Communicating with the rod hole 22 is a set screw 24 located on the longitudinal axis of the mounting block 16. The set screw 24 provides for secure attachment of the rod 17 within the rod hole 22.

In the preferred embodiment, the mounting block 16 has, on that side of the mounting hole 18 opposite the rod hole 22, a further auxillary hole 21 for attachment therein of other archery accessories. In the use of a compound bow, the auxillary accessory is likely to be a cable guide rod, (not shown) which is an elongated rod extending rearwardly to the pulley-mounted bow cables 23, and having a slotted guide member located thereon for the control of cable movement.

The bolt hole 20 will generally overlay the plane of the longitudinal midline of the bow 12, in which plane the bow string 26 is located. Thus by placing the mounting block 16 transversely to the longitudinal midline of the bow 12, the rod hole 22 is placed at a point lateral to the longitudinal midline of the bow 12 and therefore lateral to the bow string 26.

Alternative mounting block shapes or fastening arrangements to the bow, or rod, or both, will be readily recognized by the artisan and may be utilized within the scope of the present invention. Especially, the mounting block 16 may be mounted to the front of the bow 12 since the mounting hole 18 will usually extend through the bow 12 in most commercially available bows.

Together, the mounting hole 18, the mounting block 16 and its associated structures, and a suitable fastening bolt 15, form a means for attaching the rod 17 to the bow 12.

The elongated member, or rod 17, in the preferred embodiment is a rounded shaft attachable to the mounting block 16 which, as a matter of convenience, will be located on the lower part of the handle 14 of the bow 12. The arm guard 10 may be in integral part of the bow 12 as seen in FIG. 1; or the rod 17 may be attached to the bow by inserting a forward portion 42 thereof into the rod hole 22 of the mounting block 16 which is mounted on the bow 12, and tightening a set screw 24 as more fully explained below. The rod 17 has a first generally horizontal section 28 attached to the mounting block 16 and extending rearwardly therefrom in a generally horizontal plane to a point within the wrist region 30 of an archer grasping the bow in shooting form. Extending upwardly from the rearward point of the first horizontal section 28 is a generally vertical section 32 of the rod 17. The generally vertical section 32 extends the rod 17 to a point at the height of the wrist region 30 in order to place the rod 17 at the height of the bow arm 13 for the protection thereof. Extending rearwardly from the vertical section 32 is a second generally horizontal section 34. The second horizontal section extends the rod 17 to a point beyond the elbow region 36 of an archer grasping the bow in shooting form. At the rearward end of the second horizontal section 34 is a bent section 38 curving further away from the midline of the bow 12, and therefore, towards the elbow region 36 of an archer grasping the bow in a shooting form. The rod 17 ends in a rounded tip 40 so as to comfortably contact the bow arm 13 and easily deflect the bow string 26 should the string strike the rounded tip 40.

The first horizontal section 28 has a forward portion 42 for engaging the bore of the rod hole 22 in the mounting block 16. Thus, the forward portion 42 may be used to adjust the rearward extension of the guard 10 by altering the depth of the forward portion 42 within the rod hole 22. The forward portion 42 is provided with a planar surface 44 positioned so as to contact the set screw 24 when rod 17 is in its operative position. This arrangement provides a secure attachment of the rod 17 to the bow 12 so that rod 17 will not reposition itself due to the bow string 26 striking thereon, or through active use and transport of the bow 12 and the guard 10 in the field.

As shown in FIG. 2, should further adjustment of the guard length be desired, the second horizontal section can be constructed as a tube within a tube fastened together by a releasable series of detents 45 to provide a means for adjusting the guard length to accommodate variations in the bow arm length between different archers.

Thus, it will be seen that the rod 17 extends rearwardly from the bow 12 in a plane generally parallel to the plane of travel of a kinetic bow string, the rod 17 imposing itself between this kinetic string plane and the bow arm 13 of the archer. The rod 17 contacts the bow arm 13 through the bent section 38 so as to press the rounded tip 40 into the bow arm 13 beyond the elbow region 36. This arrangement provides a physical barrier to prevent a kinetic bow string 26 from striking the elbow region 36 or the forearm of the bow arm, and will keep any bulky clothing, such as hunting coveralls, out of the kinetic string path.

In the preferred embodiment, the rod 17 is formed from a rigid material to provide a strong physical, as well as psychological, barrier against bow string-induced injuries; and to prevent the rod 17 from moving or deforming upon contact with a kinetic string, thereby preventing secondary injuries caused by rod-to-arm contact. The rod will further provide a constant reference for physical placement of the rod 17 and thus the attached bow 12, in relation to the bow arm 13 to improve shooting form. This is especially true when the archer is not wearing bulky clothing such as hunting coveralls. However, when the archer is wearing bulky clothing, the rod 17 will help to keep such clothing free and clear of the kinetic bow string path to avoid fouling the shot. It is conceivable that the rod 17 could be semi-rigid or bendable and still function effectively as a part of the guard 10.

As shown in FIG. 3, to keep the rod 17 rigid, angled bends are used in the preferred embodiment to direct the rearward course of the rod 17. However, in the alternative, a curved section 46, as shown in FIG. 3 could be used to position the rod 17 upwardly from the bottom of the bow handle 14 to an operative position paralleling the bow arm 13.

By utilizing a separate mounting block 16 and a generally planar rod 17, the arm guard 10 will be easily manufactured, resulting in lower costs, and will be easily constructed and set up by the archer for usage with the bow 12. Alternatively, the arm guard 10 could be easily manufactured as an integral part of the bow, as seen in FIG. 1.

In use, the mounting block 16 is affixed to the bow 12 through the mounting hole 18 located on the bow handle 14 by use of a threaded bolt 15. The set screw 24 is withdrawn from communication with the rod hole 22 and the forward portion 42 of the rod 17 is inserted into rod hole 22 to a depth which places the rounded tip 40 at the desired area of the elbow region 36 of the bow arm 13. The rod 17 is then secured by placing the set screw 24 into abutment with the rod 17 at the planar surface 44 thereof.

The archer may then assume a shooting form, placing at least the rounded tip 40 of the bent section 38 against the flesh of the bow arm elbow region 36, with the bent section 38 following the contour of the bow arm 13, thereby eliminating a path for a kinetic bow string between the guard 10 and the bow arm 13 and also preventing secondary injuries from rod-to-bow arm contact should the bow string 26 strike the rod 17 and force the rod into the bow arm.

Should an errant release of the bow string 26 cause the string to travel in a path that would contact the arm, the bow string 26 is not allowed to travel under the rod 17 due to the abutment of the rounded tip 40 and bent section 38 against the bow arm 13. These elements will channel a kinetic string 26 back towards the bow 17 longitudinal midline and/or along the second horizontal section 34 thereby protecting the bow arm of the archer.

Having, thus, described the invention what is claimed is:

1. An arm guard for attachment to a compound bow or long bow comprising:

(a) an elongated member removably attachable to a handle of the bow so as to be located laterally from a longitudinal midline of the bow and proximal to a position occupied by an arm of an archer in operating the bow, the elongated member having a length greater than a forearm of the archer and extending past an elbow of the archer to prevent injury to the forearm caused by release of a bow string;

(b) means for attaching the elongated member to a bow, the means for attaching comprising:

a body comprising:

(1) a rectangular block having a central mounting hole and a rod hole; and (2) means for mounting the block to the bow including the central mounting hole formed in the body and a bolt passable through the central mounting hole and securable to the bow;

(3) means for securing the elongated member to the body; and (4) means for mounting the body to the bow;

wherein the rod hole is formed in the body lateral to the central mounting hole for securably receiving the elongated member.

2. An arm guard for attachment to a compound bow or long bow comprising:

(a) an elongated member removably attachable to a handle of the bow so as to be located laterally from a longitudinal midline of the bow and proximal to a position occupied by an arm of an archer in operating the bow, the elongated member having a length greater than a forearm of the archer and extending past an elbow of the archer to prevent injury to the forearm caused by release of a bow string;

(b) means for attaching the elongated member to a bow, the means for attaching comprising:

a body mountable on the bow, the body including means for mounting the body to the bow, and means for securing the elongated member to the body, wherein the elongated member comprises:

a first generally horizontal section, (1) extending from the mountable body rearwardly to a wrist area of a bow arm of an archer, (2) a generally vertical section extending upwardly from the first horizontal section to the wrist area of the bow arm of the archer; and, (3) a second generally horizontal section extending rearwardly from a wrist area of the bow arm to an elbow area of the bow arm and generally parallel to the bow arm.

3. The arm guard of claim 2, wherein the second generally horizontal section further comprises; a bent section at a rearward portion of the second generally horizontal section, the bent section turning away from the longitudinal midline of the bow so as to rest on an elbow region of an arm of an archer operating the bow.

4. The arm guard of claim 2, wherein the elongated member is rigid.

5. The arm guard of claim 2, wherein the elongated member is a rod.

6. The arm guard of claim 5, wherein the rod has a rounded rearward tip.

7. The arm guard of claim 2, wherein the elongated member is adjustable in length.

8. An arm guard for attachment to a compound bow or a long bow comprising:

(a) a single elongated member attachable to a handle of the bow so as to be located laterally from a longitudinal midline of the bow and proximal to a position occupied by an arm of an archer operating the bow; wherein the elongated member having a length greater than a forearm length of the archer, and wherein further the elongated member is indirectly attachable to the handle;

(b) means for attaching the elongated member to the bow comprising:

(1) a body mountable on the bow, the body including means for mounting the body to the bow and, (2) means for securing the elongated member to the body, wherein the body is a rectangular block having a central mounting hole and a rod hole; the means for mounting the block to the bow includes the central mounting hole formed in the body and a bolt passable through the central mounting hole and securable to the bow; and the rod hole is located in the body lateral to the central mounting hole for securably receiving the elongated member.

9. The arm guard of claim 8 wherein the elongated member has a threaded end for attachment to the bow and a non-threaded end for contacting an arm of the archer.

* * * * *